US008760216B2

(12) United States Patent
Iriarte et al.

(10) Patent No.: US 8,760,216 B2
(45) Date of Patent: Jun. 24, 2014

(54) REFERENCE VOLTAGE GENERATORS FOR INTEGRATED CIRCUITS

(75) Inventors: Santiago Iriarte, Valencia (ES); Alberto Marinas, El Puig (ES); Colm Donovan, Valencia (ES); Eduardo Martinez, Valencia (ES)

(73) Assignee: Analog Devices, Inc., Norwood, MA (US)

( * ) Notice: Subject to any disclaimer, the term of this patent is extended or adjusted under 35 U.S.C. 154(b) by 465 days.

(21) Appl. No.: 12/762,456

(22) Filed: Apr. 19, 2010

(65) Prior Publication Data

US 2010/0308902 A1 Dec. 9, 2010

Related U.S. Application Data

(60) Provisional application No. 61/185,411, filed on Jun. 9, 2009.

(51) Int. Cl.
*G05F 1/10* (2006.01)

(52) U.S. Cl.
USPC ..... 327/513; 327/512

(58) Field of Classification Search
USPC ..... 327/512, 513, 539
See application file for complete search history.

(56) References Cited

U.S. PATENT DOCUMENTS 3,899,693 A * 8/1975 Gaudreault ..... 327/513
4,399,374 A 8/1983 Boeke
4,507,573 A 3/1985 Nagano
4,792,750 A 12/1988 Yan
5,070,322 A * 12/1991 Fujihira ..... 340/653
5,187,395 A * 2/1993 Pirez ..... 327/362
5,245,273 A * 9/1993 Greaves et al. ..... 323/313
5,627,456 A 5/1997 Novof et al.
5,694,033 A 12/1997 Wei et al.
5,796,244 A * 8/1998 Chen et al. ..... 323/313
5,798,669 A * 8/1998 Klughart ..... 327/539

(Continued)

FOREIGN PATENT DOCUMENTS

DE 3110167 1/1982
DE 19530472 2/1996
DE 19940382 3/2001
DE 69727349 12/2004

OTHER PUBLICATIONS

Camacho-Galeano et al., Temperature Performance of Sub-1V Ultra-Low Power Current Sources, May 20, 2008, IEEE, IEEE International Symposium on Circuits and Systems, 2008. ISCAS 2008, pp. 2230-2233.*

(Continued)

*Primary Examiner* — Thomas J Hiltunen
(74) *Attorney, Agent, or Firm* — Kenyon & Kenyon, LLP

(57) ABSTRACT

A reference voltage generator circuit may include at least one MOS transistor and at least one bipolar transistor coupled together to provide an electrical path from an input reference potential to an output of the generator circuit. The electrical path may extend through a gate-to-source path of the MOS transistor and further through a base-to-emitter path of the bipolar transistor. The MOS transistor may be biased by a bias current that is proportional to $T^2 \cdot \mu(T)$, where T represents absolute temperature and $\mu(T)$ represents mobility of a MOS transistor in the bias current generator. Optionally, the reference voltage generator may include N MOS and M multiple bipolar transistors ($N \geq 1$, $M \geq 1$), and the output reference voltage may be $N*V_{GS}+M*V_{BE}$ as compared to the input reference potential.

23 Claims, 7 Drawing Sheets

(56) References Cited

U.S. PATENT DOCUMENTS

| | | | | |
|---|---|---|---|---|
| 5,949,278 | A | 9/1999 | Oguey | |
| 5,955,874 | A | 9/1999 | Zhou et al. | |
| 6,184,745 | B1 | 2/2001 | Kim | |
| 6,353,365 | B1 | 3/2002 | Barnes | |
| 6,466,083 | B1 | 10/2002 | Barnes | |
| 6,468,825 | B1 * | 10/2002 | Machida et al. | 438/48 |
| 6,529,066 | B1 * | 3/2003 | Guenot et al. | 327/539 |
| 6,686,797 | B1 * | 2/2004 | Eker | 327/539 |
| 6,733,174 | B2 * | 5/2004 | Matsumoto et al. | 374/178 |
| 7,072,259 | B2 | 7/2006 | Yanagi | |
| 7,116,158 | B2 * | 10/2006 | Teel et al. | 327/539 |
| 7,236,048 | B1 * | 6/2007 | Holloway et al. | 327/539 |
| 7,372,244 | B2 * | 5/2008 | Marinca | 323/316 |
| 7,449,941 | B2 | 11/2008 | Zadeh et al. | |
| 7,573,325 | B2 | 8/2009 | Garcia | |
| 7,579,898 | B2 * | 8/2009 | Soldera et al. | 327/512 |
| 7,609,045 | B2 * | 10/2009 | Wang | 323/314 |
| 7,688,561 | B2 * | 3/2010 | Ku et al. | 361/91.1 |
| 7,901,134 | B2 * | 3/2011 | Sudo | 374/173 |
| 7,994,848 | B2 * | 8/2011 | Kothandaraman et al. | 327/539 |
| 7,997,794 | B2 * | 8/2011 | Igarashi | 374/178 |
| 8,022,744 | B2 * | 9/2011 | Lalithambika et al. | 327/291 |
| 8,058,863 | B2 * | 11/2011 | Cho et al. | 323/316 |
| 8,072,259 | B1 * | 12/2011 | Isik | 327/538 |
| 8,305,068 | B2 * | 11/2012 | Camacho Galeano et al. | 323/313 |
| 8,330,526 | B2 * | 12/2012 | Vilas Boas et al. | 327/512 |
| 8,421,435 | B2 * | 4/2013 | Hirose et al. | 323/315 |
| 8,432,214 | B2 * | 4/2013 | Olmos et al. | 327/512 |
| 2002/0039044 | A1 | 4/2002 | Kwak et al. | |
| 2004/0150465 | A1 | 8/2004 | Nishida et al. | |
| 2006/0001412 | A1 | 1/2006 | Fernald | |
| 2006/0132223 | A1 | 6/2006 | Cherek | |
| 2006/0226464 | A1 * | 10/2006 | Gatta | 257/303 |
| 2007/0146061 | A1 | 6/2007 | Iriarte | |
| 2008/0297229 | A1 * | 12/2008 | Ramamoorthy | 327/513 |
| 2009/0153227 | A1 * | 6/2009 | Ooe et al. | 327/512 |
| 2010/0008398 | A1 * | 1/2010 | Nojima | 374/178 |
| 2010/0127687 | A1 * | 5/2010 | Boas et al. | 323/311 |
| 2012/0182062 | A1 * | 7/2012 | Sugiura et al. | 327/512 |
| 2012/0323508 | A1 * | 12/2012 | Vilas Boas et al. | 702/60 |

OTHER PUBLICATIONS

"A CMOS Temperature-Compensated Current Reference", IEEE Journal of Solid-State Circuits, vol. 23, No. 3, Jun. 1988, pp. 821-824.

Wiley Encyclopedia of Electrical and Electronics Engineering, 1999, John Wiley & Sons, Inc., pp. 454-462.

* cited by examiner

100

300

400

700

600

500

1000

900

800

1300

1200

1100

1500

1400

1700

1600

1800

REFERENCE VOLTAGE GENERATORS FOR INTEGRATED CIRCUITS

CROSS-REFERENCE TO RELATED APPLICATION

This application claims the benefit of priority afforded by provisional application Ser. No. 61/185,411, filed Jun. 9, 2009.

BACKGROUND

Many integrated circuit designs, especially those used for mobile devices, desire low powered solutions to improve system performance and battery life. The generation of an accurate reference voltage conventionally utilizes circuits that include one or more resistors. In a low power environment, the size of resistors can become very large and thus the required chip area becomes very large in most integrated processes. Therefore, a need exists for a low power solution to produce an accurate reference voltage that only requires a small chip area.

DETAILED DESCRIPTION

Figure 1:
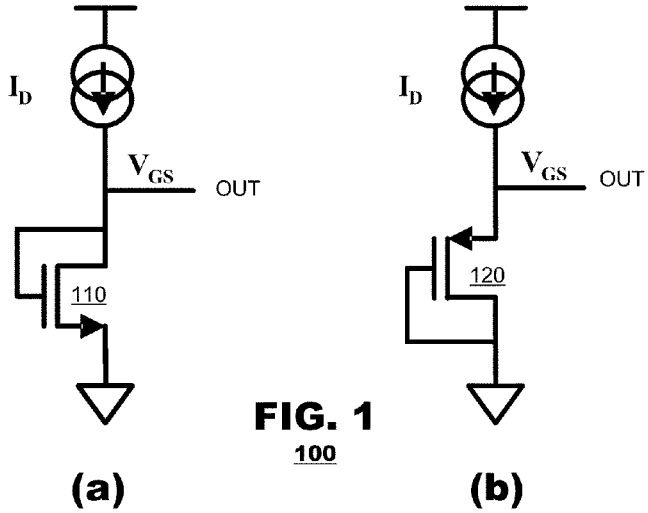
FIGS. 1(*a*) and 1(*b*) are circuit diagrams illustrating biased NMOS and PMOS transistors according to an embodiment of the present invention.

Embodiments of the present invention provide a reference voltage generator that includes at least one MOS transistor and at least one bipolar transistor coupled together to provide an electrical path from an input reference potential to an output of the generator circuit. The electrical path may extend through a gate-to-source path of the MOS transistor and further through a base-to-emitter path of the bipolar transistor. The MOS transistor may be biased by a bias current that is proportional to $T^2 \cdot \mu(T)$, where T represents absolute temperature and $\mu(T)$ represents mobility of a MOS transistor in a bias current generator. Generally, the reference voltage generator may include N MOS and M multiple bipolar transistors ($N \geq 1$, $M \geq 1$), and the output reference voltage may be $N*V_{GS}+M*V_{BE}$ as compared to the input reference potential.

The current solution utilizes two types of transistors to produce an accurate reference voltage in a low power environment. In addition, the current solution produces an accurate reference signal without the use of resistors, resulting in a small chip area requirement. The first type of transistor may be a MOS transistor, either NMOS or PMOS. The second type of transistor may be a bipolar junction transistor, which may be NPN or PNP type. Alternatively, the second type of transistor may be replaced by a diode. The reference voltage is generated by combining threshold voltages from the MOS transistor and bipolar transistors at an output. Specifically, circuit connections are created to couple a gate-to-source threshold voltage $V_{GS}$ from the MOS transistor and a base-to-emitter threshold voltage $V_{BE}$ from the bipolar transistor between ground or some other voltage reference and an output. By combining $V_{GS}$ and $V_{BE}$, variations in manufacturing have a reduced impact on the generated reference voltage resulting in a reduced rate of error.

In bipolar transistors, a base-to-emitter threshold voltage $V_{BE}$ has a negative temperature coefficient. As temperature increases, $V_{BE}$ decreases. In MOS transistors, the gate-to-source voltage $V_{GS}$ and its temperature coefficient vary based on a bias current applied to it. When used in conjunction with the bipolar transistor, a MOS transistor may be biased so that $V_{GS}$ has a positive temperature coefficient. In this manner, the negative temperature coefficient of $V_{BE}$ may be canceled using the positive temperature coefficient of $V_{GS}$ and a stable output voltage may be obtained. To accurately achieve cancellation of the $V_{BE}$ negative temperature coefficient, an aspect ratio (W/L) and a bias current may be chosen such that $V_{GS}$ has a sufficiently positive temperature coefficient to overcome the negative temperature coefficient of the bipolar transistor.

The proposed reference voltage generators herein provide voltage generators that avoid use of resistors within the generator circuits. The voltage generators require small transistors to implement which, as compared to voltage generators that use resistors, conserve the area of integrated circuits in which the solution is provided. Accordingly, the proposed solutions provide a highly accurate reference signal in a low power environment while only using a small chip area.

The discussion herein describes temperature variation using terms as follows:

- $I_{PTAT}$ (Proportional to Absolute Temperature): Any current that has a temperature coefficient proportional to T.
- $I_{PTAT'}$: Any current that has a temperature coefficient approximately proportional to $T^2 \cdot \mu(T)$, where $\mu(T)$ represents mobility of transistors in a bias source as discussed below.
- $I_{CTAT}$ (Complementary to Absolute Temperature): Any current that has a negative temperature coefficient.

FIGS. 1(*a*) and 1(*b*) are circuit diagrams illustrating conventional NMOS and PMOS transistors for use in one embodiment of the present invention. FIG. 1(*a*) illustrates an NMOS transistor 110 having a gate and drain connected in common to a bias current source $I_D$ and a source coupled to ground. FIG. 1 (*b*) illustrates a PMOS transistor 120 having a source coupled to a bias current source ID and a drain and gate coupled to ground. In both embodiments, a voltage $V_{GS}$ is generated at an output terminal OUT, which may be used as one component of a reference voltage.

In general, the temperature coefficient of voltage $V_{GS}$ varies based upon the ratio and the temperature coefficient of bias current $I_D$ passing through the transistor to an aspect ratio (W/L) of the transistor. This can be seen in the following equations:

$$V_{GS} = V_{TH} + \sqrt{\frac{I_D}{\frac{1}{2} \cdot \mu(T) \cdot C_{OX} \cdot \frac{W}{L}}}, \text{ where} \qquad \text{Eq. (1.)}$$

$V_{TH}$ is the threshold voltage, $\mu(T)$ represents a temperature-varying mobility of electrons of an NMOS transistor or the mobility of holes of a PMOS transistor, T represents absolute temperature and $C_{ox}$ represents the oxide capacitance of the MOS gate. For NMOS and PMOS transistors, $V_{TH}$ always has a negative, generally linear temperature coefficient (e.g., $V_{TH} \propto -T$).

According to an embodiment, to create a positive temperature coefficient for $V_{GS}$, operation of the bias current source $I_D$ may be chosen to generate a current:

$$I_D \propto T^2 \cdot \mu(T) \quad \text{Eq. (2.)}$$

When current bias $I_D$ exhibits PTAT' properties, Eq. 1 reduces to:

$$V_{GS} \approx V_{TH} + K_1 \cdot T, \quad \text{Eq. (3.)}$$

where $K_1$ represents remaining constant values over temperature. Thus, the value for W/L can be chosen in order to have a $V_{GS}$ with a negative, constant or positive (but linear) temperature coefficient.

Figure 2:
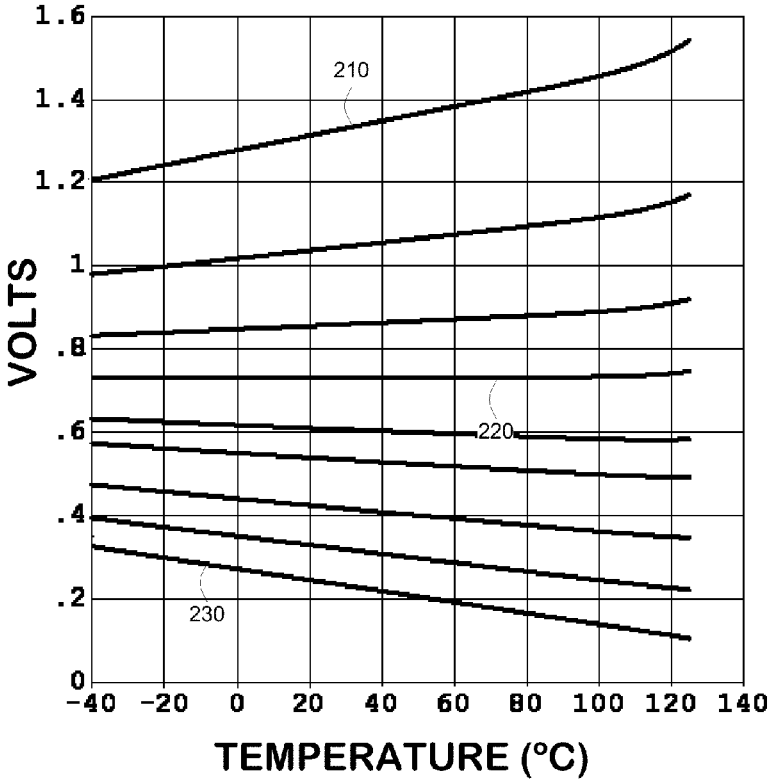
FIG. 2 is a graph simulating variation of $V_{GS}$ vs. temperature for transistors under PTAT' biasing.

FIG. 2 is a graph illustrating simulations of $V_{GS}$ vs. temperature with PTAT' biasing for different transistor aspect ratios (W/L). As illustrated, different values for W/L can generate corresponding variations in the temperature coefficient $V_{GS}$. W/L parameter selections may induce voltage variations that increase with increasing temperature (graph 210), that are generally constant over temperature (graph 220), or decrease with increasing temperature (graph 230). Graph 210, for example, illustrates a temperature coefficient that increases from 1.2 volts at −40° C. to approximately 1.5V at 120° C. Graph 220 represents another selection of W/L parameters that maintain $V_{GS}$ at a generally constant level—approximately 0.75V for all temperatures from −40° C. to 120° C. Graph 230 illustrates a further selection of W/L parameters for which $V_{GS}$ decreases with increasing temperature, from approximately 0.3V at −40° C. to about 0.1V at 120° C. In a preferred embodiment, the value for W/L is chosen such that a temperature coefficient corresponding to graph 210 is generated using PTAT' biasing. In this manner, the transistor 110, 120 may be coupled to a bipolar transistor and the positive $V_{GS}$ temperature coefficient may negate the negative temperate coefficient $V_{BE}$ of the bipolar transistor.

Figure 3:
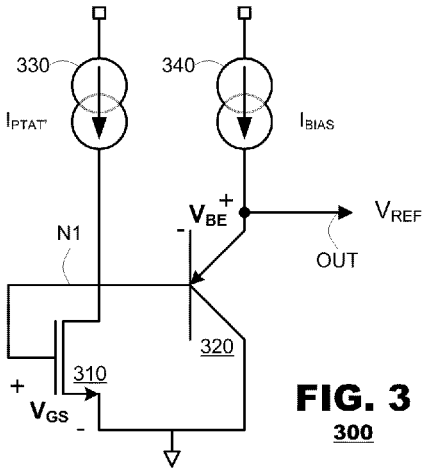
FIG. 3 is a circuit diagram illustrating a reference voltage generator according to an embodiment of the present invention.

FIG. 3 is a circuit diagram illustrating a reference voltage generator 300 according to an embodiment of the present invention. As illustrated, the reference voltage generator 300 may include a MOS transistor 310 and a bipolar transistor 320. The bias generator 300 may include a pair of bias current sources 330, 340. The bias generator 330 to the MOS transistor 310 may provide PTAT' biasing. The bias generator 340 to the bipolar transistor 320 provides a current bias that may but need not have PTAT' properties. The embodiment of FIG. 3 illustrates an NMOS transistor 310 but PMOS transistors may be used, if desired. Further, the bipolar transistor is illustrated as a PNP transistor but an NPN transistor may be used. The reference voltage generator 300 omits use of a resistor to generate a reference voltage on the output terminal OUT. The bias generator 330 is made without using resistors, which provides an area-efficient design for the reference voltage generator 300.

As illustrated, the MOS transistor 310 may be provided as a diode-connected transistor in which the gate and drain terminals are connected together (node N1). The gate and drain terminals may be connected to a bias current generator 330. The transistor's source may be connected to ground. During operation, a potential of $V_{GS}$ may be established at node N1. A base of the bipolar transistor 320 also may be coupled to the first current source 330 at node N1. The bipolar transistor's emitter may be coupled to the second current source 340 and to the output terminal OUT. A collector of transistor 320 may be connected to ground. During operation, a potential difference of $V_{BE}$ may be established between the output terminal OUT and node N1. Measured with respect to ground, the voltage at the output terminal OUT may be:

$$V_{OUT} = V_{GS} + V_{BE}. \quad \text{Eq. (4.)}$$

In an embodiment, the current sources 330, 340 may be provided as $I_{PTAT'}$ sources which induce operation in the MOS transistor 310 as shown in Eq. 3 above. In such an embodiment, the reference voltage may be given by:

$$V_{OUT} = V_{GS} + V_{BE} = (V_{TH} + V_{BE}) + K_1 \cdot T \quad \text{Eq. (5.)}$$

The MOS transistor 310 may be biased using a PTAT' bias current and a corresponding W/L value such that $V_{GS}$ has a positive temperature coefficient that may cancel the negative temperature coefficient of $V_{BE}$ presented by transistor 320. For bipolar transistors, voltage $V_{BE}$ always has a negative temperature coefficient. Similarly, $V_{TH}$ also has a negative temperature coefficient. The sum of $V_{BE}$ and $V_{TH}$ is complementary to absolute temperature (CTAT). As previously discussed with respect to FIG. 1, the bias current $I_{PTAT'}$ may be used in conjunction with a corresponding W/L value to generate a positive temperature coefficient that is proportional to absolute temperature (PTAT) and is inversely proportional to the sum of the negative temperature coefficient components.

Figure 4:
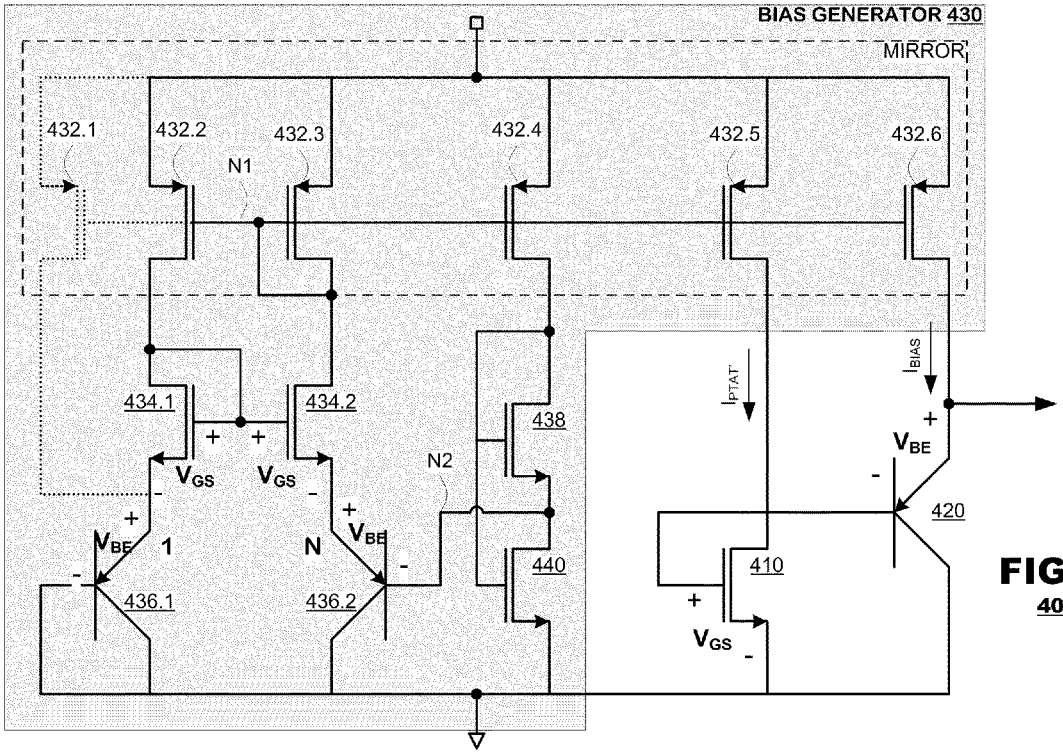
FIG. 4 illustrates a reference voltage generator according to an embodiment of the present invention.

FIG. 4 illustrates a reference voltage generator 400 according to an embodiment of the present invention. There, the voltage generator 400 may include a MOS transistor 410 and a bipolar transistor 420 as discussed in the FIG. 3 embodiment. FIG. 4 illustrates a bias current generator 430 that may generate a PTAT' current to both transistors 410, 420.

The bias generator 430 may include a current mirror, such as may be formed by transistors 432.1-432.6. Transistors 432.5, 432.6 may supply bias currents to the transistors 410, 420 that constitute the reference voltage generator. The bias generator 430 further may include paired MOS transistors 434.1, 434.2 and bipolar transistors 436.1, 436.2 that provide parallel conductive paths from transistors 432.2, 432.3 of the current mirror to ground. Transistors 434.1, 434.2 also may be provided with a current mirror configuration in which the gate of transistor 434.1 is connected to its drain. The bias generator 430 may be configured to provide different current densities in bipolar transistors 436.1, 436.2. For example, the sizes of the bipolar transistors 436.1, 436.2 may be provided with a predetermined ratio between them (e.g., 1:N). Alternatively, one of the bipolar transistors 436.1 may be fed by a larger amount of current than the other 436.2. In the example of FIG. 4, for example, multiple mirror transistors 432.1 (shown in phantom), 432.2 are shown feeding current to bipolar transistor 436.1 where only one mirror transistor 432.3 is shown to feed bipolar transistor 436.2. Current density differentials also may be generated by using size variations and current variations in combination.

The bias generator is shown with a third conductive path that includes mirror transistor 432.4 and transistors 438, 440. During operation, the voltage at node N2, which is input to the base of bipolar transistor 436.2 is determined by the voltage drop across transistor 440. Transistor 440 operates in a triode region. As a consequence, the bias current applied to the MOS transistor 410 of the reference voltage generator may exhibit PTAT' properties.

In the circuit of FIG. 4, the bias current $I_{PTAT'}$ may be generated according to:

$$I_{PTAT'} = \frac{\Delta V_{BE}^2 \cdot 2\mu_N C_{OX}}{\frac{1}{\left(\frac{W}{L}\right)_1}\left[\sqrt{1+2\frac{\left(\frac{W}{L}\right)_1}{\left(\frac{W}{L}\right)_2}}-1\right]^2}, \quad \text{Eq. (6.)}$$

where $$\left(\frac{W}{L}\right)_1$$

represents length and width of transistor 438 and $$\left(\frac{W}{L}\right)_2$$

represents length and width of transistor 440. Thus, the bias current generator 430 may generate a bias current that is proportional to $T^2 \cdot \mu(T)$ without use of resistors within the circuit.

In the example of FIG. 4, transistors 432.1-432.6 are shown as PMOS transistors and transistors 434.1, 434.2, 438 and 440 are shown as NMOS transistors. Such device types are exemplary. If desired, the device types may be reversed, for example, using NMOS transistors 432.1-432.6 and PMOS transistors 434.1, 434.2, 438 and 440. Similarly, device types of transistors 436.1, 436.2 could be reversed (e.g., NPN's for PNP's).

In another embodiment, the transistors 434.1, 434.2 could be replaced by an operational amplifier (not shown). In this embodiment, drains of transistors 432.2, 432.3 would be connected directly to respective emitters of transistors 436.1, 436.2. Operational amplifier inputs would be connected respectively to emitters of the transistors 436.1, 436.2 as well. An output of the operational amplifier may be coupled to gates of transistors 432.2, 432.3 and other transistors of the current mirror.

The example of FIG. 4 illustrates bipolar transistor 420 connected to the same bias generator 430 as the MOS transistor 410. As noted above, it is permissible but not necessary to bias the bipolar transistor 420 with a current bias that has PTAT' properties. In the example illustrated in FIG. 4, the bias generator 430 provides a convenient source from which to bias both the MOS transistors and bipolar transistors in the voltage reference generator circuit.

The resistorless bias generator shown below is one example of a bias generator that may be used to produce current bias $I_{PTAT'}$. It can be appreciated that other resistorless solutions may be used to generate current bias $I_{PTAT'}$. Representative examples are shown in U.S. Pat. No. 4,792,750, U.S. Pat. No. 5,949,278 and U.S. Publ'n. 2007/0146061.

The principles of the present invention accommodate several variations of MOS and bipolar transistors to generate reference voltages at desired levels. A reference voltage generator will include at least one MOS transistor and at least one bipolar transistor but multiples of either type of transistor (or both) are permitted. The following figures illustrate other circuit configurations according to the principles of the present invention.

Figure 5:
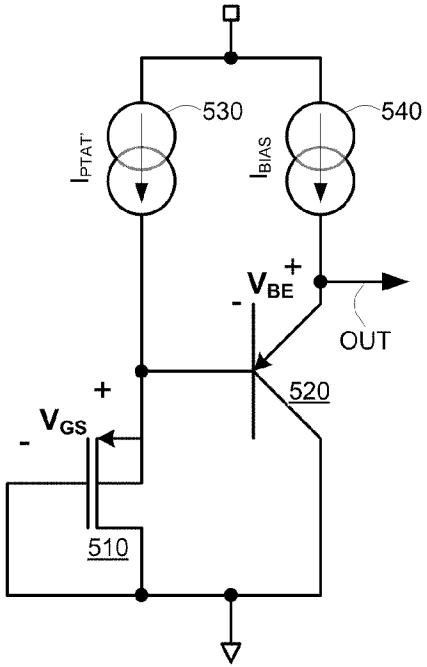

FIG. 5 is a circuit diagram of a voltage reference generator 500 according to another embodiment of the present invention. This embodiment is similar to the embodiment of FIG. 3, as it includes a MOS transistor 510, bipolar transistor 520, $I_{PTAT'}$ current source 530 and bias current source 540. In this embodiment, MOS transistor 510 is shown as a PMOS transistor in which the gate and drain terminals are connected to ground. A source terminal may be connected to $I_{PTAT'}$ bias source 530 and to the base of bipolar transistor 520. An emitter terminal of the bipolar transistor 520 may be connected to the second bias source 540 and to an output terminal of the circuit. A collector of the bipolar transistor 520 also may be coupled to ground. Alternatively, a PMOS bulk may be connected to the source, which may be used to eliminate body effect of the transistor. During operation, the voltage reference generator 500 may output a reference voltage as $V_{OUT}=V_{GS}+V_{BE}$.

Figure 6:
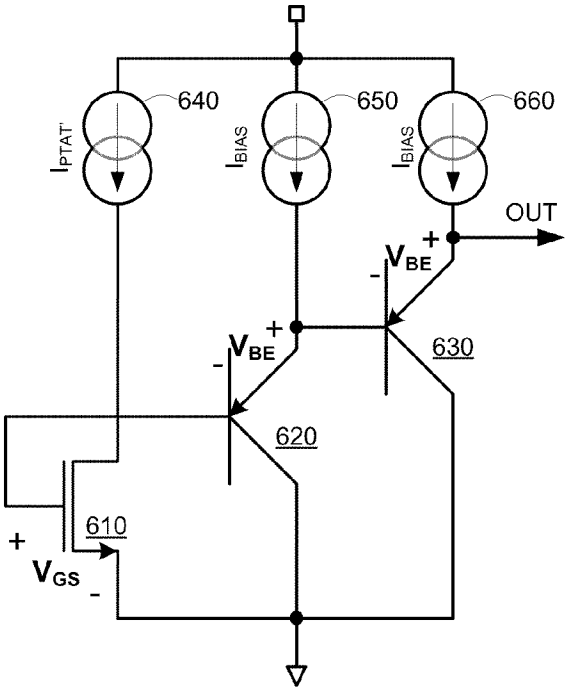

FIG. 6 is a circuit diagram of a voltage reference generator 600 according to a further embodiment of the present invention. The reference generator 600 may include a MOS transistor 610, a pair of bipolar transistors 620, 630, an $I_{PTAT'}$ current source 640 and additional current sources 650-660. As illustrated, the gate and drain of the MOS transistor 610 may be connected to the base of a first bipolar transistor 620 and also to a bias current source 640. An emitter of the first bipolar transistor 620 may be coupled to a base of the second bipolar transistor 630 and also to a bias current source 650. An emitter of the second bipolar transistor 630 may be taken as an output of the reference generator 600 and may be coupled to a bias current source 660. A source of the MOS transistor 610 and collectors of the two bipolar transistors 620, 630 may be coupled to ground. During operation, the voltage reference generator 600 may output a reference voltage as $V_{OUT}=V_{GS}+2*V_{BE}$. The principles of the present invention may be extended to include an arbitrary number N of bipolar transistors ($N \geq 2$) to output a reference voltage as $V_{OUT}=V_{GS}+N*V_{BE}$.

Figure 7:
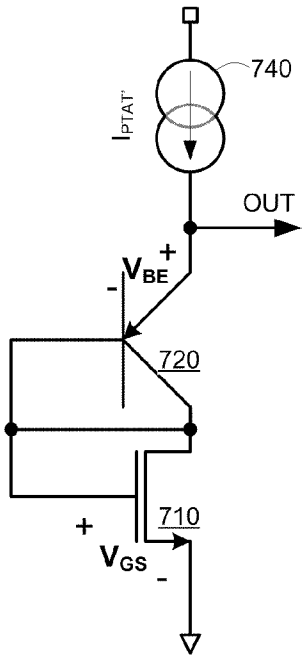
FIGS. 5-18 are circuit diagrams of voltage reference generators according to various embodiments of the present invention.

FIG. 7 illustrates a circuit configuration of a reference voltage generator 700 according to another embodiment of the present invention. In this embodiment, the reference generator 700 includes a MOS transistor 710 and bipolar transistor 720 provided in a stacked configuration and driven by an $I_{PTAT'}$ current source 730. That is, a gate and drain of the MOS transistor 710 may be connected to a collector and a base of the bipolar transistor 720. A source of the MOS transistor 710 may be connected to $V_{SS}$ (typically, ground). An emitter of the bipolar transistor 720 may be connected to the current source 730 and to an output terminal of the reference generator 700. During operation, the voltage reference generator 700 may output a reference voltage as $V_{OUT}=V_{GS}+V_{BE}$.

Figure 8:
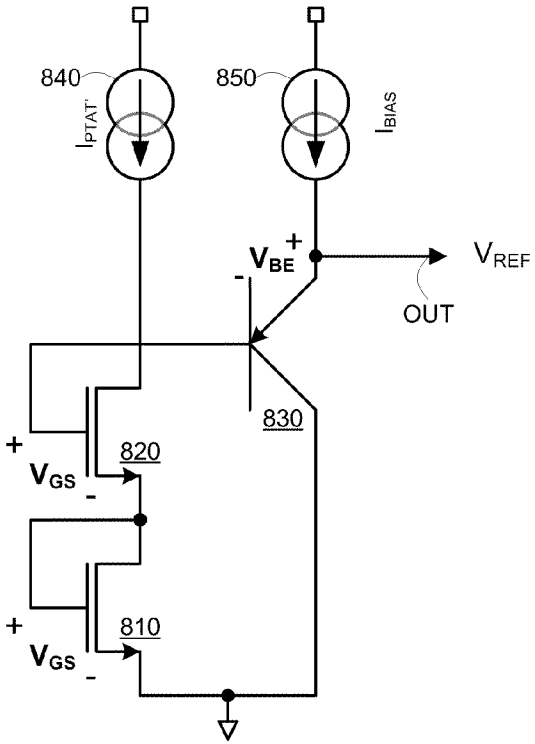

FIG. 8 illustrates a circuit configuration of a reference voltage generator 800 according to another embodiment of the present invention. In this embodiment, the voltage generator 800 may include a pair of MOS transistors 810, 820, a bipolar transistor 830, an $I_{PTAT'}$ current source 840 and a second current source 850. The MOS transistors 810, 820 may be coupled in diode-connected fashion, with the gates of each transistor 810, 820 coupled to its own drain. The source of transistor 820 may be coupled to the drain of transistor 810. The drain of transistor 820 further may be coupled to the base of transistor 830 and to an $I_{PTAT'}$ bias source 840. The emitter of transistor 830 may be coupled to the second current source 850 and further to an output of the voltage generator 800. During operation, the voltage reference generator 800 may output a reference voltage as $V_{OUT}=2*V_{GS}+V_{BE}$. The principles of the present invention may be extended to include an arbitrary number N of MOS transistors ($N \geq 2$), the output a reference voltage as $V_{OUT}=N*V_{GS}+V_{BE}$. Further, circuits may include an arbitrary number of MOS and bipolar transistors to generate a reference voltage $V_{OUT}=N*V_{GS}+M*V_{BE}$ for any N and M.

Figure 9:
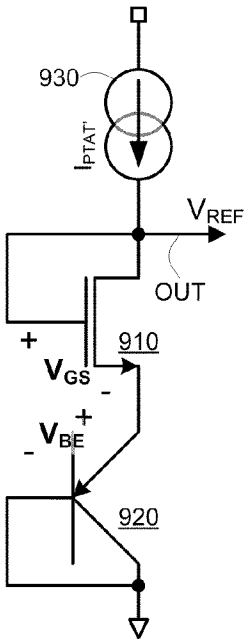

FIG. 9 illustrates a circuit configuration of a reference voltage generator 900 according to another embodiment of the present invention. The reference generator 900 may include a MOS transistor 910, a bipolar transistor 920 and an $I_{PTAT'}$ current generator 930. The bipolar transistor 920 may have its base and collector both coupled to ground and its emitter coupled to a source of the MOS transistor 910. The gate and drain of the MOS transistor 910 may be coupled to the current generator 930 and also to an output of the reference generator 900. During operation, the voltage reference generator 900 may output a reference voltage as $V_{OUT}=V_{GS}+V_{BE}$.

As noted, various types of MOS transistors and bipolar transistors can be used for the reference voltage generators. The reference voltage generators illustrated in FIGS. 3 and 6-9 are examples of voltage generators that use NMOS transistors and PNP bipolar transistors. The reference voltage generators illustrated in FIGS. 10-11 use NMOS transistors and NPN bipolar transistors. Further, the reference voltage generators illustrated in FIGS. 5 and 12-15 use PMOS transistors and PNP bipolar transistors and the reference voltage generators illustrated in FIGS. 16-18 use NMOS transistors and PNP bipolar transistors.

Figure 10:
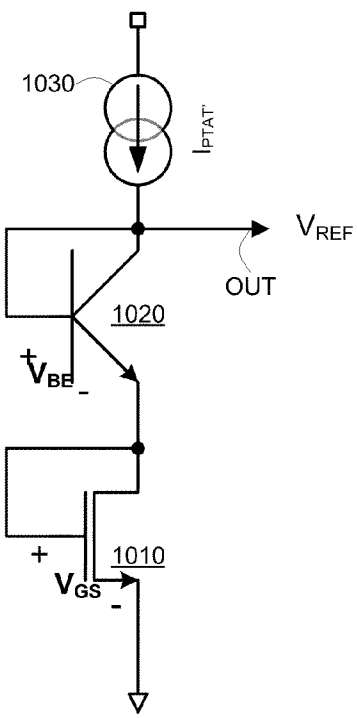

FIG. 10 illustrates a circuit configuration of a reference voltage generator 1000 according to another embodiment of the present invention. The reference generator 1000 may include a MOS transistor 1010, a bipolar transistor 1020 and an $I_{PTAT'}$ current generator 1030. The MOS transistor 1010 may have its source coupled to ground and its gate and drain coupled to an emitter of the bipolar transistor 1020. The base and collector of the bipolar transistor 1020 may be coupled to the current generator 1030 and also to an output of the reference generator 1000. During operation, the voltage reference generator 1000 may output a reference voltage as $V_{OUT}=V_{GS}+V_{BE}$.

Figure 11:
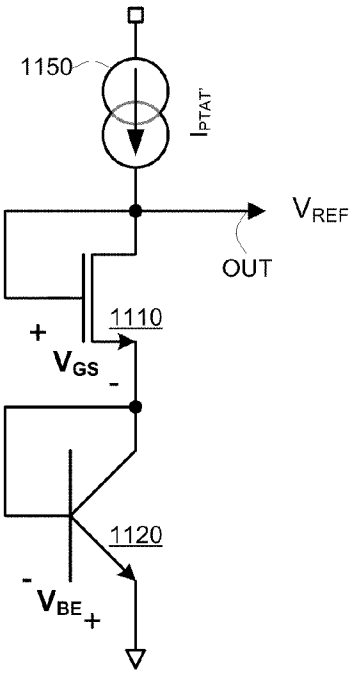

FIG. 11 illustrates a circuit configuration of a reference voltage generator 1100 according to another embodiment of the present invention. The reference generator 1100 may include a MOS transistor 1110, a bipolar transistor 1120 and an $I_{PTAT'}$ current generator 1130. An emitter of the bipolar transistor 1120 may be coupled to ground. A base and collector of the bipolar transistor may be coupled to a source of the MOS transistor 1110. A gate and drain of the MOS transistor 1110 may be coupled to the bias current source and also to an output of the reference voltage generator 1100. During operation, the voltage reference generator 1100 may output a reference voltage as $V_{OUT}=V_{GS}+V_{BE}$.

Figure 12:
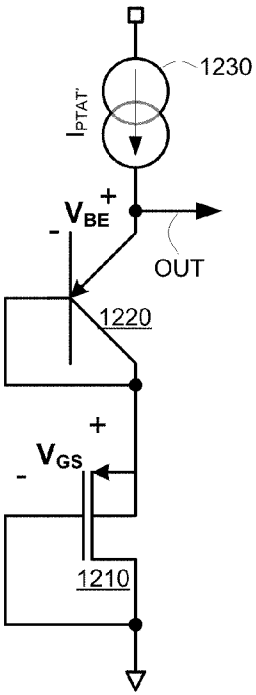

FIG. 12 illustrates a circuit configuration of a reference voltage generator 1200 according to another embodiment of the present invention. The reference generator 1200 may include a MOS transistor 1212, a bipolar transistor 1220 and an $I_{PTAT'}$ current source 1230. As illustrated, a gate and drain of the MOS transistor 1210 may be coupled to ground and a source may be coupled to a base and a collector of the bipolar transistor 1220. An emitter of the bipolar transistor may be coupled the current source 1230 and to an output of the reference voltage generator 1200. During operation, the voltage reference generator 1200 may output a reference voltage as $V_{OUT}=V_{GS}+V_{BE}$.

Figure 13:
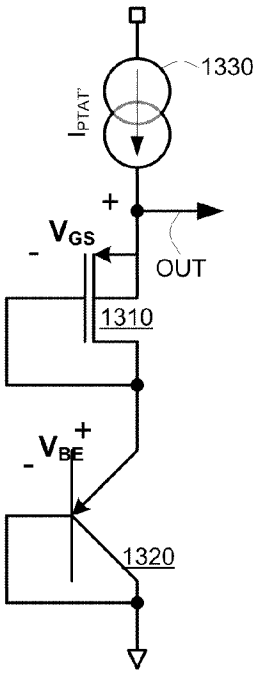

FIG. 13 illustrates a circuit configuration of a reference voltage generator 1300 according to another embodiment of the present invention. The reference generator 1300 may include a MOS transistor 1313, a bipolar transistor 1320 and an $I_{PTAT'}$ current source 1330. As illustrated, a base and a collector of the bipolar transistor 1320 may be coupled to ground. An emitter of the bipolar transistor may be coupled to a gate and a drain of the MOS transistor 1310. A source of the MOS transistor 1310 may be coupled to the current source 1330 and to an output of the reference voltage generator 1300. During operation, the voltage reference generator 1300 may output a reference voltage as $V_{OUT}=V_{GS}+V_{BE}$.

Figure 14:
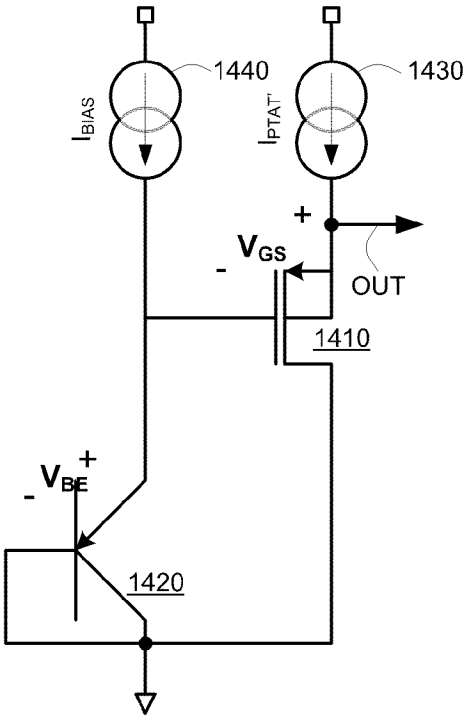

FIG. 14 illustrates a circuit configuration of a reference voltage generator 1400 according to another embodiment of the present invention. The reference generator 1400 may include a MOS transistor 1410, a bipolar transistor 1420, an $I_{PTAT'}$ current source 1430 and a second current source 1440. A base and a collector of the bipolar transistor 1420 may be connected to ground. An emitter of the bipolar transistor may be connected to a gate of the MOS transistor 1410 and to the second current source 1440. A source of the MOS transistor 1410 may be coupled to the IPTAT' current source 1430 and to an output of the reference voltage generator 1400. A drain of the MOS transistor 1410 may be connected to ground. During operation, the voltage reference generator 1400 may output a reference voltage as $V_{OUT}=V_{GS}+V_{BE}$.

Figure 15:
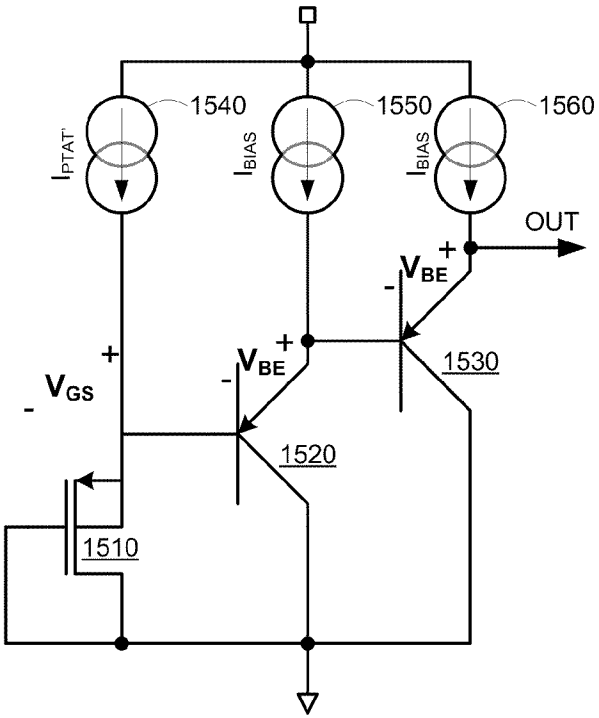

FIG. 15 illustrates a circuit configuration of a reference voltage generator 1500 according to another embodiment of the present invention. The reference generator 1500 may include a MOS transistor 1510, a pair of bipolar transistors 1520, 1530, an $I_{PTAT'}$ current source 1540 and secondary current sources 1550, 1560. A gate and drain of the MOS transistor 1510 may be connected to ground. A source of the MOS transistor 1510 may be connected to a base of bipolar transistor 1520 and also to the $I_{PTAT'}$ current source 1540. An emitter of bipolar transistor 1520 may be connected to a base of bipolar transistor 1530 and also to a bias current source 1550. An emitter of bipolar transistor 1530 may be connected to a bias current source 1560 and also to an output terminal of the reference voltage generator 1500. Collectors of the bipolar transistors 1520 and 1530 may be connected to ground. During operation, the voltage reference generator 1500 may output a reference voltage as $V_{OUT}=V_{GS}+2*V_{BE}$. The principles of the present invention may be extended to include an arbitrary number N of bipolar transistors ($N\geq 2$) to output a reference voltage as $V_{OUT}=V_{GS}+N*V_{BE}$.

Figure 16:
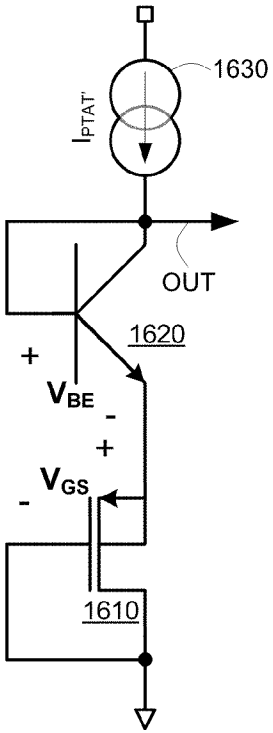

FIG. 16 illustrates a circuit configuration of a reference voltage generator 1600 according to another embodiment of the present invention. The reference generator 1600 may include a MOS transistor 1610, a bipolar transistor 1620 and an $I_{PTAT'}$ current generator 1630. A gate and drain of the MOS transistor 1610 may be connected to ground. A source of the MOS transistor 1610 may be connected to an emitter of the bipolar transistor 1620. A base and a collector of the bipolar transistor 1620 may be coupled to the $I_{PTAT'}$ current generator 1630 and to an output of the reference voltage generator 1600. During operation, the voltage reference generator 1600 may output a reference voltage as $V_{OUT}=V_{GS}+V_{BE}$.

Figure 17:
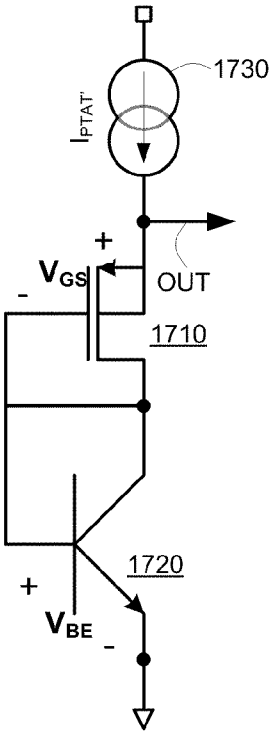

FIG. 17 illustrates a circuit configuration of a reference voltage generator 1700 according to another embodiment of the present invention. The reference generator 1700 may include a MOS transistor 1710, a bipolar transistor 1720 and an $I_{PTAT'}$ current generator 1730. An emitter of the bipolar transistor 1720 may be connected to ground. A base and collector of the bipolar transistor 1720 may be connected to a gate and drain of the MOS transistor 1710. A source of the MOS transistor may be connected to the $I_{PTAT'}$ current generator 1730 and to an output of the reference voltage generator 1700. During operation, the voltage reference generator 1700 may output a reference voltage as $V_{OUT}=V_{GS}+V_{BE}$.

Figure 18:
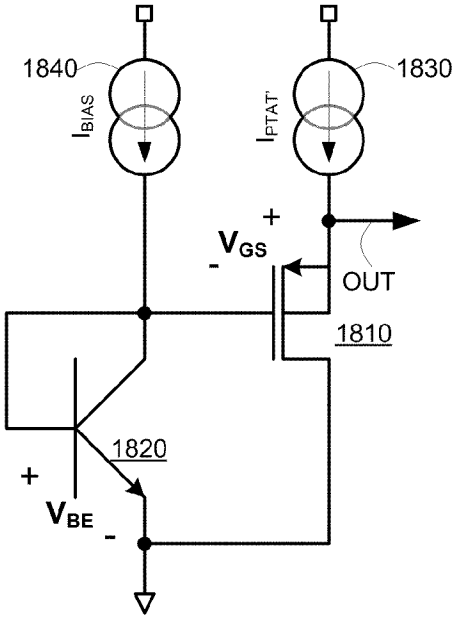

FIG. 18 illustrates a circuit configuration of a reference voltage generator 1800 according to another embodiment of the present invention. The reference generator 1800 may include a MOS transistor 1810, a bipolar transistor 1820, an $I_{PTAT'}$ current source 1830 and a second current source 1840. An emitter of the bipolar transistor 1820 may be connected to ground. A base and a collector of the bipolar transistor may be connected to a gate of the MOS transistor 1810 and to the second current source 1840. A source of the MOS transistor 1810 may be coupled to the IPTAT' current source 1830 and to an output of the reference voltage generator 1800. A drain of the MOS transistor 1810 may be connected to ground. During operation, the voltage reference generator 1800 may output a reference voltage as $V_{OUT}=V_{GS}+V_{BE}$.

Several embodiments of the invention are specifically illustrated and/or described herein. However, it will be appreciated that modifications and variations of the invention are covered by the above teachings and within the purview of the appended claims without departing from the spirit and intended scope of the invention. For example, the voltage reference generators are illustrated as connected to ground and, therefore, the $V_{OUT}$ equations listed above represent voltage offsets with respect to ground. If desired, the voltage reference generators may be connected to other voltage sources, which would generate reference voltage outputs that are offset from the respective voltage sources by the amounts given in the respective $V_{OUT}$ equations. Further variations are permissible that are consistent with the principles described above.

We claim:

1. A reference voltage generator circuit, comprising:

a MOS transistor and a bipolar transistor coupled together to provide an electrical path from a reference potential to an output of the generator circuit that extends through a gate-to-source path of the MOS transistor and further through a base-to-emitter path of the bipolar transistor, wherein the MOS transistor has an associated gate-to-source voltage $V_{GS}$, a bias current generator providing a bias current to the MOS transistor that is proportional to $T^2 \cdot \mu(T)$, where T represents absolute temperature and $\mu(T)$ represents mobility of a MOS transistor in the bias current generator, and the output providing a reference voltage that is approximately temperature independent.

2. The reference voltage generator circuit of claim 1, further comprising a second MOS transistor arranged to have the electrical path extend through a gate-to-source path thereof.

3. The reference voltage generator circuit of claim 2, further comprising a second bipolar transistor arranged to have the electrical path extend through a base-to-emitter path thereof.

4. The reference voltage generator circuit of claim 1, further comprising a second bipolar transistor arranged to have the electrical path extend through a base-to-emitter path thereof.

5. The reference voltage generator circuit of claim 4, further comprising a second MOS transistor arranged to have the electrical path extend through a gate-to-source path thereof.

6. The reference voltage generator circuit of claim 1, wherein the reference voltage is expressed as:

$$V_{REF}=V_{GS}+V_{BE},$$

where $V_{REF}$ is the reference voltage and $V_{BE}$ is the base-to-emitter of the bipolar transistor.

7. The reference voltage generator circuit of claim 1, wherein the reference voltage is expressed as:

$$V_{REF}=N*V_{GS}+M*V_{BE},$$

where VREF is the reference voltage, N is an integer number of MOS transistors, M is an integer number of bipolar transistors, and VBE is the base-to-emitter of the bipolar transistor.

8. The reference voltage generator circuit of claim 1, wherein the reference potential is ground.

9. The reference voltage generator circuit of claim 1, wherein the output provides the reference voltage that includes a base-to-emitter voltage $V_{BE}$ of the bipolar transistor and the gate-to-source voltage $V_{GS}$, the base-to-emitter voltage $V_{BE}$ including a negative temperature coefficient and the gate-to-source voltage $V_{GS}$ including a positive temperature coefficient canceling the negative temperature coefficient.

10. A reference voltage generator circuit, comprising:

an integer number N of MOS transistors and an integer number M of bipolar transistors coupled together to provide an electrical path from a reference potential to an output of the generator circuit that extends through gate-to-source paths of the MOS transistors and further through base-to-emitter paths of the bipolar transistors, wherein each MOS transistor has an associated gate-to-source voltage $V_{GS}$ and each bipolar transistor has an associated base-to-emitter voltage $V_{BE}$, a bias current generator providing a bias current to the MOS transistor that is proportional to $T^2 \cdot \mu(T)$, where T represents absolute temperature and $\mu(T)$ represents mobility of a MOS transistor in the bias current generator, wherein the generator circuit creates an output voltage that is approximately temperature independent and that is offset from the reference by $N*V_{Gs}+M*V_{BE}$.

11. The reference voltage generator circuit of claim 10, wherein the reference potential is ground.

12. A reference voltage generator circuit, comprising:

a diode-connected MOS transistor connected between a first current source and a first potential source, a bipolar transistor having a base connected to a gate and drain of the MOS transistor, a collector coupled to the first potential source and an emitter coupled to a second current source, an output of the generator circuit providing a reference voltage that is approximately temperature independent and that extends through a gate-to-source path of the MOS transistor and further through a base-to-emitter path of the bipolar transistor, and wherein the first and second current sources provide bias currents to the respective transistors that are proportional to temperature squared multiplied by mobility of MOS transistors of the respective first and second current sources.

13. The reference voltage generator circuit of claim 12, further comprising a second diode-connected MOS transistor connected between the first MOS transistor and the first potential source.

14. The reference voltage generator circuit of claim 12, further comprising a second bipolar transistor having a base connected to the emitter of the first bipolar transistor, a collector coupled to the first potential source and an emitter coupled to another current source.

15. The reference voltage generator circuit of claim 12, wherein the potential source is ground.

16. A reference voltage generator circuit, comprising:

a plurality of diode-connected MOS transistors connected in a chain between a first current source and a potential source, a bipolar transistor having a base connected to a gate and drain of one of the MOS transistors, a collector coupled to the potential source and an emitter coupled to a second current source, an output of the generator circuit providing a reference voltage that is approximately temperature independent and that extends through a gate-to-source path of the MOS transistors and further through a base-to-emitter path of the bipolar transistor, and wherein the first and second current sources provide bias currents that are proportional to $T^2 \cdot \mu(T)$, where T represents absolute temperature and $\mu(T)$ represents mobility of MOS transistors in the first current source.

17. The reference voltage generator circuit of claim 16, further comprising a second bipolar transistor having a base connected to the emitter of the first bipolar transistor, a collector coupled to the potential source and an emitter coupled to another current source.

18. A reference voltage generator circuit, comprising:

a diode-connected MOS transistor connected between a first current source and a potential source, wherein the diode-connected MOS transistor has an associated gate-to-source voltage $V_{GS}$, a pair of bipolar transistors each having a collector coupled to the potential source and an emitter respectively coupled to second or third current sources, a bias of the first bipolar transistor coupled to a drain of the MOS transistor and a bias of the second bipolar transistor coupled to the emitter of the first bipolar transistor, and an output providing a reference voltage that includes a $V_{GS}$ component and is approximately temperature independent, wherein the first, second and third current sources provide bias currents to the respective transistors that are proportional to $T^2 \cdot \mu(T)$, where T represents absolute temperature and $\mu(T)$ represents mobility of a MOS transistor in the first current source.

19. The reference voltage generator circuit of claim 18, further comprising a second diode-connected MOS transistor provided between the first MOS transistor and the potential source.

20. The reference voltage generator circuit of claim 18, wherein the potential source is ground.

21. A reference voltage generator circuit, comprising:

a diode-connected MOS transistor connected between a first current source and a potential source, wherein the diode-connected MOS transistor has an associated gate-to-source voltage $V_{GS}$, a plurality of bipolar transistors connected in a cascaded chain, each bipolar transistor having a collector coupled to the potential source and an emitter coupled to a respective current source, a bias of the first bipolar transistor coupled to a drain of the MOS transistor and biases of remaining bipolar transistors coupled to emitters of prior bipolar transistors in the chain, wherein an emitter of a final bipolar transistor is an output of the generator circuit, and an output providing a reference voltage that is approximately temperature independent, wherein the current sources provide bias currents to the respective transistors that are proportional to $T^2 \cdot \mu(T)$, where T represents absolute temperature and $\mu(T)$ represents mobility of a MOS transistor in the first current source.

22. The reference voltage generator circuit of claim 21, further comprising a second diode-connected MOS transistor provided between the first MOS transistor and the potential source.

23. The reference voltage generator circuit of claim 21, wherein the potential source is ground.

* * * * *

UNITED STATES PATENT AND TRADEMARK OFFICE

CERTIFICATE OF CORRECTION

PATENT NO. : 8,760,216 B2
APPLICATION NO. : 12/762456
DATED : June 24, 2014
INVENTOR(S) : Santiago Iriarte et al.

It is certified that error appears in the above-identified patent and that said Letters Patent is hereby corrected as shown below:

IN THE CLAIMS:

Column 10, line 37, please change:

"$N*V_{Gs}+M*V_{BE}$" to --$N*V_{GS}+M*V_{BE}$--.

Signed and Sealed this
Thirteenth Day of January, 2015

Michelle K. Lee

Michelle K. Lee
*Deputy Director of the United States Patent and Trademark Office*